United States Patent [19]

Ramsay

[11] Patent Number: 4,572,059

[45] Date of Patent: Feb. 25, 1986

[54] STATIC VENTILATOR CONSTRUCTION

[76] Inventor: Jean R. Ramsay, 6161 Des Angevins, Ville d'Anjou, Québec, Canada

[21] Appl. No.: 637,768

[22] Filed: Aug. 6, 1984

[51] Int. Cl.[4] ..... F23L 17/02

[52] U.S. Cl. ..... 98/42.22; 98/66.1

[58] Field of Search ..... 98/18, 37, 42 A, 66.1, 98/66 A, 79, 42.22

[56] References Cited

U.S. PATENT DOCUMENTS

| | | | |
|---|---|---|---|
| 418,305 | 12/1889 | Blaikie | 98/37 |
| 1,230,305 | 6/1917 | Klay | 98/42.1 |
| 1,657,625 | 1/1928 | Hoal | 98/121 R |

*Primary Examiner*—William E. Wayner

[57] ABSTRACT

A static ventilator comprising a hollow housing having a circumferential sidewall, a closed top end, and an open bottom end. One or more vent openings are horizontally disposed in the sidewall. At least two downwardly sloping hood plates are secured above and below each of the vent openings and have a downwardly extending outer end flange having a free end edge. An anti-squall deflector plate is secured below the vent openings intermediate the hood plates and extend above the horizontal plane of the free end edge of a top one of the two hood plates and terminate short of the outer end flange of the top hood plate to define a vent port between the hood end flange and free end of the deflector plate communicating with the vent opening between the two hood plates. The anti-squall deflector plate prevents foreign matter from entering the vent openings.

8 Claims, 4 Drawing Figures

STATIC VENTILATOR CONSTRUCTION

BACKGROUND OF THE INVENTION (a) Field of the Invention

The present invention relates to a ventilator, and more particularly, to a static ventilator wherein the vent openings thereof are protected by anti-squall deflector plates to prevent foreign matter, such as water or snow from entering therein.

(b) Description of Prior Art

Various types of ventilators have heretofore been provided. However, the disadvantages of some of these, such as the static type, are that they do not operate effectively to create a chimney effect to draw air out of an enclosure in which they are in communication with, and they do not effectively prevent foreign matter from entering in the ventilator particularly snow during a strong snow storm having high winds. Ventilators are also provided with fans which are operated by wind currents and a disadvantage of some of these is that they are often noisy and require frequent maintenance to repair the fans. Those ventilators that require a motor to drive the fans are further energy consuming to run. Another disadvantage of some prior art ventilators is that their construction provide excellent locations for birds to nest. Still furthermore, some of these ventilators are not effective on flat roofs or cathedral roofs and consequently do not effectively ventilate the space under the roof.

SUMMARY OF INVENTION

It is a feature of the present invention to provide a static ventilator which substantially overcomes all of the above-mentioned disadvantages of the prior art.

Another feature of the present invention is to provide a static ventilator wherein the vent openings therein are protected by hood plates and anti-squall deflector plates to prevent the entry into said openings of foreign matter, such as rain, snow, etc.

Another feature of the present invention is to provide a static ventilator which is economical to construct, easy to install and which creates maximum chimney effect whereby to draw air to ventilate one or more enclosures below the roof.

According to the above features, from a broad aspect, the present invention provides a static ventilator comprising a hollow housing having a circumferential sidewall, a closed top end, and an open bottom end. One or more vent openings are horizontally disposed in the sidewall. At least two downwardly sloping flat hood plates are secured above and below each of the vent openings and have a downwardly extending outer end flange having a free end edge. An anti-squall flat deflector plate is secured below the vent openings intermediate the hood plates. The hood plates are disposed at a sloping angle which is greater than the sloping angle of the deflector plate. An unobstructed vent chamber is defined between the deflector plate and an upper one of the hood plate and communicates with one of the vent openings. The anti-squall deflector plate has a downwardly extending skirt formed at a free end edge thereof to cause a downward air flow below the deflector plate in the area of the free end edge and an upper surface of the lower adjacent one of the hood plates. The skirt terminates a short distance above the horizontal plane of the free end edge of a top one of the two hood plates and terminates short of the outer end flange of the top hood plate to define a vent post between the hood end flange and free end of the deflector plate communicating with the vent opening between the two hood plates. The anti-squall deflector plate prevents foreign matter from entering the vent openings.

BRIEF DESCRIPTION OF DRAWINGS

A preferred embodiment of the present invention will now be described with reference to the examples thereof as illustrated in the accompanying drawings in which.

DESCRIPTION OF PREFERRED EMBODIMENTS

Figures 1, 2, 3, 4:
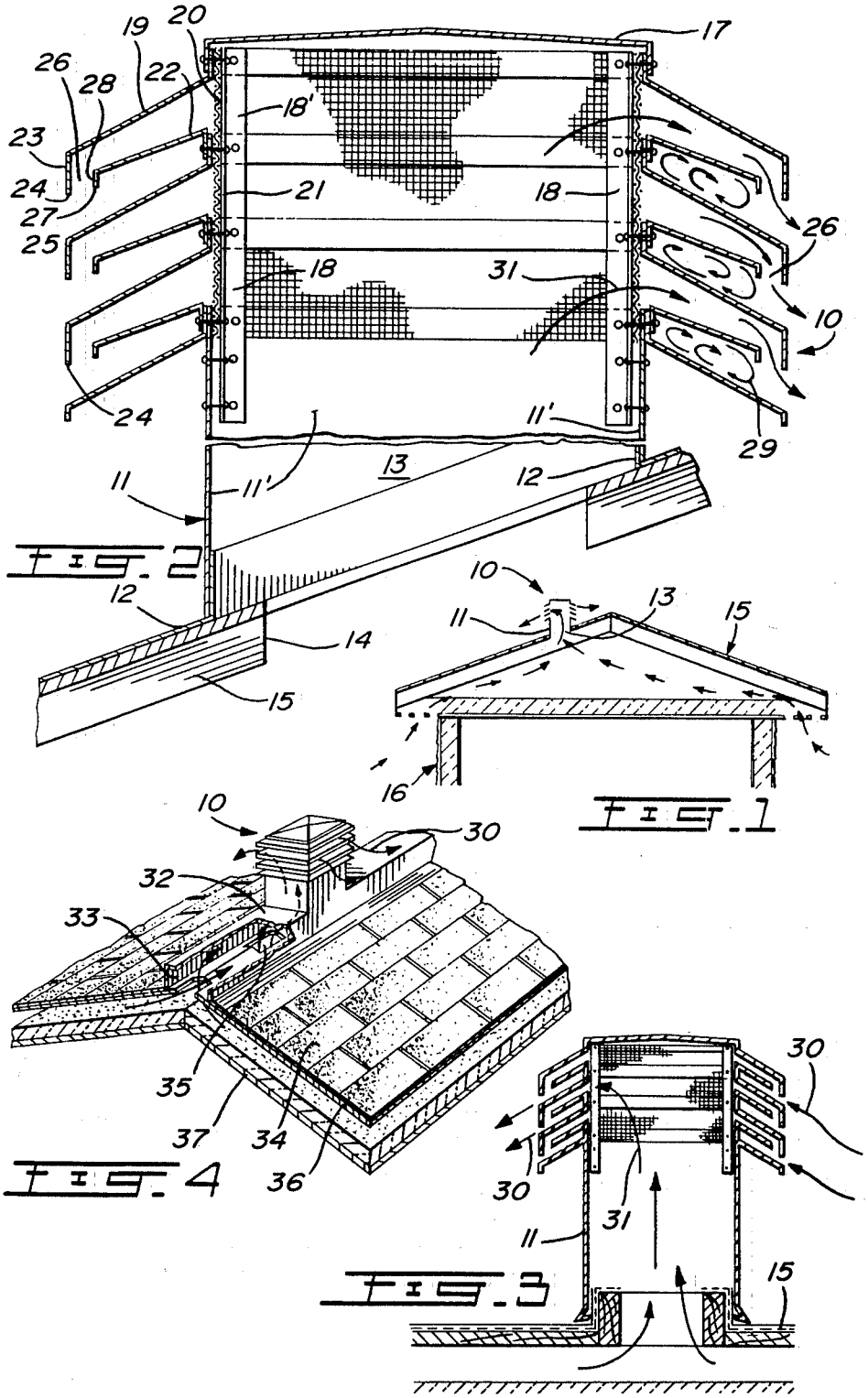
FIG. 1 is a schematic representation of the static ventilator as secured to a pitch roof.
FIG. 2 is a section view showing the construction of the static ventilator of the present invention.
FIG. 3 is a schematic representation showing an installation of the static ventilator on a flat roof and illustrating the air convection flow caused by the ventilator.
FIG. 4 is a schematic representation showing the static ventilator as secured to a cathedral roof.

Referring now to the drawings, and more particularly to FIGS. 1 and 2, there is shown generally at 10 the static ventilator of the present invention. The ventilator comprises a hollow housing 11, herein a housing of rectangular cross-section defining opposed parallel sidewalls 11' with the bottom part of the sidewall being secured to an attachment means or flange 12 whereby to secure the housing 11 with its open bottom end 13 over a port hole 14 provided in a roof 15 of a building 16. The top end of the housing 11 has a removable cover member 17.

As shown in FIG. 2, the ventilating portion (the top end portion of the housing 11) is constructed with four right angle posts 18 secured to the housing sidewalls 11' by suitable fastening means, such as screw fasteners, rivets or welds. Downwardly sloping hood plates 19, are secured in a spaced apart relationship across opposed ones of these posts 18 and transverse thereto whereby to define therebetween slotted vent openings 20. A permeable meshing 21 is secured inside the housing across the flanges 18' of the corner post whereby to protect the openings from small birds or large insects.

An anti-squall deflector plate 22 is secured intermediate opposed ones of the hood plates and secured below the vent openings 20. As shown in FIG. 2, the hood plates 19 are provided with a short downwardly extending outer end flange 23 terminating at a free end edge 24. The anti-squall deflector plate 22 extends above the horizontal plane 25 passing through the free end edge 24 of the hood plates 19 and terminates short of the outer end flange 23 of the hood plate positioned above it whereby to define a vent port 26 between the hood end flange 23 and the free end 27 of the deflector plate. The free end 27 of the anti-squall deflector plate is provided with a downwardly extending skirt 28 defining a deflector means to cause a downward air flow below the deflector plate in the area of the free end edge 27 adjacent the vent port. This air flow is illustrated by the convection arrow 29 in FIG. 2 and prevents foreign matters such as rain or powdered snow from entering the vent port. The skirt 28 terminates above the horizontal plane 25 whereby to permit this downward air flow behind the skirt 28 of the deflector plate.

The hood plates 19 and deflector plates 22 are formed of suitable metals such as aluminium or galvanized steel and the width thereof is selected whereby to suit the size and application of the ventilator. Also, the size of the vent port 26 also varies depending on the application of the ventilator. As hereinshown, the hood plates extend from the sidewall 11' of the housing 11 at a sloping angle which is greater than the sloping angle of the anti-squall deflector plate. Although not limited thereto the angle of the hood plate, as shown in FIG. 2, is approximately 25° to the horizontal and the angle of the anti-squall deflector plate extends at approximately 20° from the horizontal. These angles have been found to be most effective to create the chimney effect and to prevent ingress of foreign matter in the vent port. These plates define outwardly extending vent chamber therebetween of truncated cross-section, i.e. diminishing in width towards the vent port 26.

Referring now to FIG. 3, it can be seen that wind currents, shown by arrows 30, in the vicinity of the ventilator 10 causes a suction of air within the housing 11 in the direction of arrows 31 whereby to draw air from the area under the roof 15 of a building. Such chimney effect is well known in the art and the means of securement of such ventilators to a roof structure is also well known in the art. However, the rectangular ventilator construction of the present invention and its hood and anti-squall plates have been found very effective in creating a good chimney effect to obtain maximum draw (air suction).

FIG. 4 shows an application where a channel member 32, which comprises a generally elongated rectangular shape metal channel, is positioned along the apex 33 of a roof 34 wherein vent openings 35 are provided along the apex whereby to vent the area 36 immediately the top sheath 34 of the roof 15 and the ceiling 37 of a room therebelow, such roof construction are known as cathedral. One or more of the ventilators 10 may be secured along such channel member 32 to properly ventilate such cathedral roofs which as heretofore been a difficult task with known ventilators of the prior art.

The ventilator of the present invention may be connected to flexible piping (not shown) which connect directly to the ceiling of various rooms in a building structure, and such is well known in the art. Also, the ventilator of the present invention prevents foreign matter from entering the ventilator, such as powdered snow during a snow storm with high winds; it prevents the infiltration of rain; its construction prevents birds from nesting therein; it does not make any noise; it creates a strong chimney effect to effect good ventilation; it does not rust; it is easy to construct and install and easy to disassemble; it reduces the cost of heating a building ventilated thereby as it dries the ambient air at the interior of the enclosure; it prevents condensation in windows; it removes smoke and odors inside enclosures; it prevents rotting due to high humidity build-up in the interior of building enclosures, particularly in winter months, and is of a pleasing aesthetic design.

Tests have been performed with a ventilator constructed in accordance with the present invention and having a cross-section of one square foot. The ventilator was subjected to a snow storm during which the wind velocity reached 50 to 80 kilometers per hour and during a period of 8 hours under observation, during the storm, it was noted that no snow entered the ventilator.

It is within the ambit of the present invention to cover any obvious modifications of the example of a preferred embodiment described herein. For example, the ventilator can be constructed of any suitable material and the ventilating portion may have various configuration. For example, the ventilating portion can be provided in sections spaced from the top of the housing or the openings may be spaced in groups from one another. Also, the length of the ventilator may vary in accordance with the application thereof, as is common in the art.

I claim:

1. A static ventilator comprising a hollow housing having a circumferential sidewall, a closed top end, and an open bottom end; one or more vent openings horizontally disposed in said sidewall, at least two downwardly sloping flat hood plates secured above and below each said one or more vent openings and having a downwardly extending outer end flange having a free end edge, and an anti-squall flat deflector plate secured below said one or more vent openings intermediate said hood plates, said hood plates being disposed at a sloping angle greater than the sloping angle of said deflector plate, an unobstructed vent chamber is defined between said deflector plate and an upper one of said hood plates and communicates with one of said vent openings, said anti-squall deflector plate having a downwardly extending skirt formed at a free end edge thereof to cause a downward air flow below said deflector plate in the area of said free end edge and an upper surface of a lower adjacent one of said hood plates, said skirt terminating a short distance above the horizontal plane of said free end edge of a top one of said two hood plates and terminating short of the outer end flange of said top hood plate to define a vent port between said hood end flange and free end of said deflector plate communicating with said vent opening between said two hood plates, said deflector plate preventing foreign matter from entering said vent openings.

2. A static ventilator as claimed in claim 1 wherein said at least two hood plates and said anti-squall deflector plate are flat plates, said hood plates extending from said sidewall of said housing at a sloping angle greater than the sloping angle of said anti-squall deflector plate whereby to define a sloping chamber therebetween diminishing in width toward said vent port.

3. A static ventilator as claimed in claim 1 wherein there is a plurality of said hood plates secured above and below a plurality of said vent openings, said openings being elongated slotted openings disposed parallel to one another.

4. A static ventilator as claimed in claim 3 wherein said housing is a vertically extending hollow tubular housing of rectangular cross-section, said slotted openings being formed in planar alignment in each sidewall of said rectangular housing.

5. A static ventilator as claimed in claim 4 wherein a removable cover is secured about an open top end of said tubular housing to constitute said enclosed top end.

6. A static ventilator as claimed in claim 5 wherein said rectangular housing is provided with high angle corner posts extending in at least a ventilating portion thereof, said hood plates being secured across opposed ones of said posts and transverse thereto, said slotted vent openings being defined by the area between said posts and opposed ones of said hood plates, and an air permeable meshing secured over said openings.

7. A static ventilator as claimed in claim 1 wherein there is further provided attachment means to secure said housing open bottom end over a post hole provided in a roof of a building.

8. A static ventilator as claimed in claim 1 wherein said housing open bottom end is secured to a channel member in communication with a space below a roof of a building.

* * * * *